US005888147A

United States Patent [19]

Luedtke

[11] Patent Number: 5,888,147

[45] Date of Patent: Mar. 30, 1999

[54] DIVOT HIT/PORTABLE GOLF PRACTICE MAT

[76] Inventor: William E. Luedtke, 2 Jeanette Ct., Jamesburg, N.J. 08831

[21] Appl. No.: 944,128

[22] Filed: Oct. 6, 1997

Related U.S. Application Data

[63] Continuation-in-part of Ser. No. 771,858, Dec. 23, 1996, abandoned.

[51] Int. Cl.[6] ..... A63B 69/36

[52] U.S. Cl. ..... 473/278; 473/393

[58] Field of Search ..... 473/278, 393

[56] References Cited

U.S. PATENT DOCUMENTS 3,139,283 6/1964 Lester ..... 473/278

4,130,283 12/1978 Lindquist ..... 473/278 X 4,932,663 6/1990 Makar ..... 473/278 X

*Primary Examiner*—George J. Marlo

[57] ABSTRACT

A portable golf practice mat comprised of two independent pieces of a divot and an anchor working in conjunction with each other that is extremely portable to the extent that it can be carried in any standard golf bag due to it's small size and flexibility yet performs well with a full swing and standard golf ball simulating the feel and forgiveness of a natural fairway and maintaining a level lie by replacing a natural divot with an artificial grass divot of equal size, made of any commercially available artificial grass, that is anchored to the ground for continuous shots, anywhere.

4 Claims, 3 Drawing Sheets

DIVOT HIT/PORTABLE GOLF PRACTICE MAT

This application is a continuation-in-part of Ser. No. 08/771,858, filed Dec. 23, 1996, now abandoned.

BACKGROUND OF THE INVENTION

1. Field of the Invention

This invention relates to a portable golf practice mat. More specifically, the invention relates to a golf practice mat which is extremely portable to the extent that it can be carried as standard equipment in any golf bag due to its small size and flexibility yet performs well with a full swing and standard golf ball, duplicating the feel and forgiveness associated with a natural fairway shot and maintaining a level lie with the surrounding surface so the golfer does not adapt his swing to the mat by changing the swing plane arc while providing a stable hitting area from which to hit continuous shots, anywhere.

2. Description of the Prior Art

The concept of providing a golf practice mat and more specifically, a practice mat which simulates the feel of a natural fairway allowing a downward blow of the club under the ball and movement of the hitting surface like that of taking a divot are available but not well known as they are not widely used. Historically, golf practice mats were constructed using inverted brushes or strips of artificial grass permanently fastened to a stationary surface. The old mats were durable but did not "give" with the shot increasing the chance of harm or damage to person or equipment, or both. They were not portable and were used mostly at designated practice facilities.

Today's more conventional mats employ construction of artificial turf material molded to rubber cushions to protect equipment, however, there is no "give" in these mats either which can cause injury to the left shoulder, elbow, or wrists after continuous use. Also, a descending blow under and through the ball can not be achieved as the club bounces off the mat upon impact. The nature of their construction makes them very heavy and large, typically 4 feet square and not at all portable. Smaller mats of similar construction have an added heavy rubber base to hold the mats in place. These mats react similar to the larger range mats and are even less forgiving as they rest above the ground in an elevated position, causing one to change their golf swing to scoop the ball or flatten their swing plane arc to avoid injury. They too are heavy and are relatively large usually constructed to a size of 1 foot by 2 feet to allow enough weight to be stable. This eliminates their portability.

More forgiving mats were created all with the similar intent of reducing resistance, allowing a downward blow, and creating a more natural like feel to that of a fairway. They were created to improve upon the stationary and unforgiving mats. However, they incorporate configurations that resulted in an elevated lie or rigid apparatus that necessitated a swing plane arc change or permanent placement to have any practicality. Also, they employ elastic tethers to achieve the "give" feeling by placing two tethers at opposite sides of the mat to offset the forward and reverse movements of the mat, placing one forward and one back or one on each side perpendicular to the forward and back motion resulting in either case with tethers in the hitting area increasing the chance of damage or injury, especially if used with a small portable mat.

SUMMARY OF THE INVENTION

As noted, none of the prior art practice mats to date addressed the problem of portability while maintaining the "give" of a natural turf which is desired. The present invention provides a portable mat that is small and lightweight so it can be carried in any standard golf bag, yet durable while maintaining that simulated natural fairway feeling of "give" and doing so from a level lie to ensure a true swing plane arc with a full swing like that experienced on the golf course. The improved two piece configuration permits all elastic rubber bands to be behind the hitting area. With the anchor piece also behind the hitting area, it is able to absorb the return force of the moving divot piece without relying on a second series of bands in front or to the sides of the divot. In the portable practice golf mat there are no elastic tethers with metal spikes or teflon guides and sleds or steel tubing and cables or heavy rubber bases in the hitting area which is key to maintaining portability; they are too dangerous in use with a small mat. The complicated configurations of previous mats in an attempt to create a natural feeling took them beyond practicality which perhaps explains their relative nonexistence today in any practice facilities.

As a person familiar with the art of golf realizes, there is a desire to hit practice shots from grass areas, however, most ranges have eliminated these areas due to the high maintenance cost of natural grass. Parks and homeowners limit golf practice also for this reason. These areas are quickly destroyed to dirt by repeated golf shots resulting in divots. The portable practice golf mat allows the replacement of the first divot created with an artificial grass divot. It provides a fairway like lie to hit shots with a natural appearance using all golfer friendly materials thus eliminating any fear experienced by the golfer that a mishit will result in damage or injury.

The portable golf practice mat is simple in construction which attests to its uniqueness. It succeeds where all other previous ideas failed. It provides a stable hitting surface with the feel and movement experienced on a natural fairway allowing for a downward blow under the ball with no real or apparent impediments to the swing which can cause damage or injury or just mental intimidation due to presence of unnatural devices to a golf swing. It is portable, durable, lightweight and can be carried in any golf bag as standard equipment much like a golf glove or extra tees, yet it performs as wall or better than other complicated and non portable devices. It's simple construction should be viewed as capturing the essence of a portable golf mat achieved by incorporating the unique two piece construction of a divot piece independent of but working in conjunction with the anchor piece, connected only by the elastic rubber bands. No invention to date has been able to capture all the key factors of a portable golf practice mat while maintaining it's durability, feasibility, and effectiveness.

DESCRIPTION OF THE PREFERRED EMBODIMENT OF THE INVENTION

Figure 1:
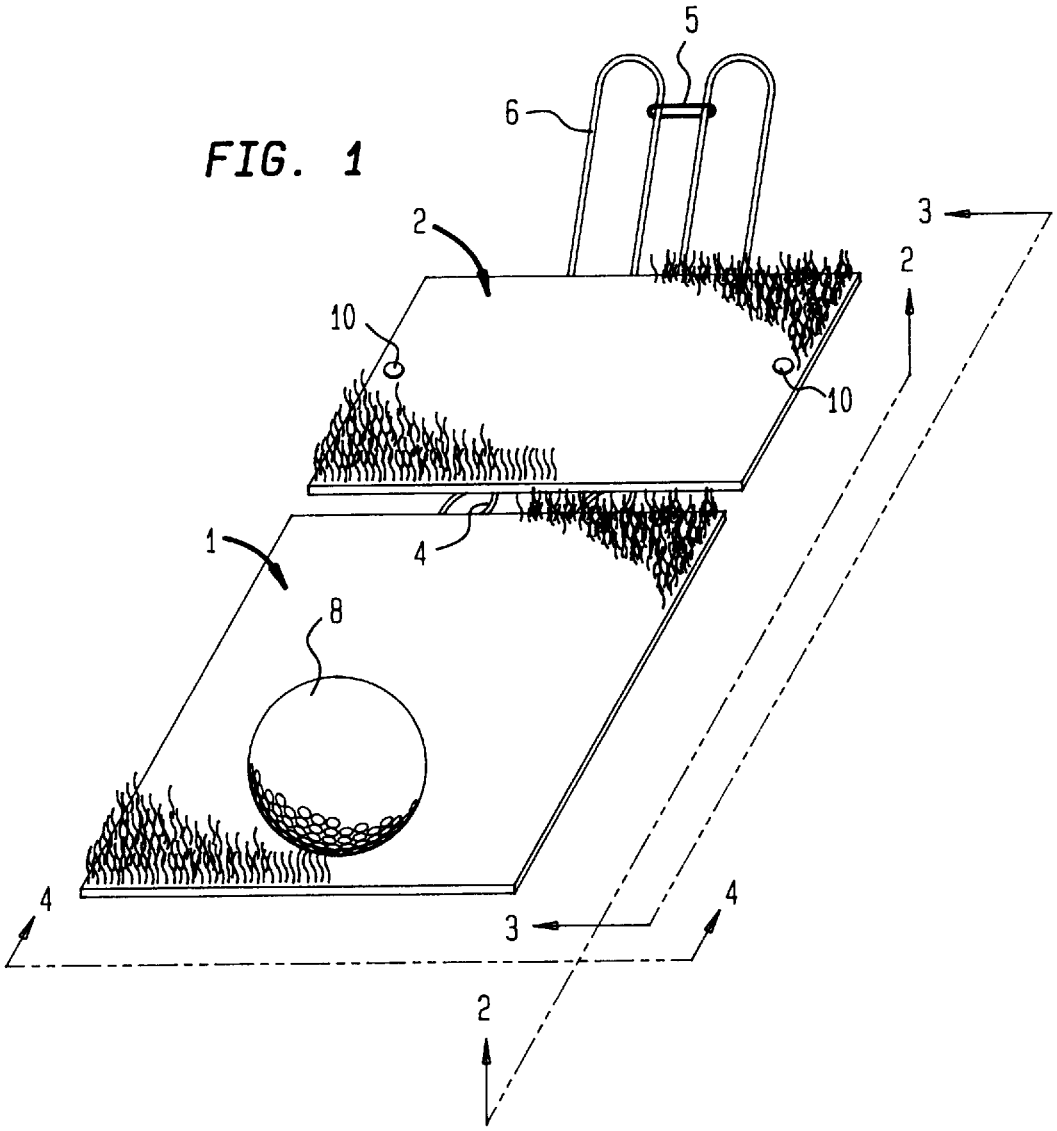
FIG. 1 is a perspective view of a device constructed according to the present invention.

The improved portable golf practice mat according to the present invention, how it performs, how it differs from previous inventions, and the advantages over the prior art devices becomes apparent by reference to the attached drawings. FIG. 1 illustrates the preferred embodiment of the improved portable golf practice mat according to the present invention reflecting the apparatus's simple construction and golfer friendly appearance and form.

Referring to FIG. 1, the device of the invention has two pieces 1 and 2 of equal width of 3.5 inches of any suitable artificial "turf". While the size of the divot piece 1 can vary, as can the material used in it's construction, the length of the front piece 1 in the preferred embodiment is 8 inches. The 8 inch length provides sufficient distance from the anchor piece 2 providing a comfort level in case of a mishit while limiting the force exerted by the returning divot piece 1 by limiting it's mass. The width as reflected in the preferred embodiment is 3.5 inches which will accommodate any standard size club, but it can be increased to accommodate today's oversize clubs. Providing consistent line, the anchor piece 2 is also 3.5 inches wide and is 4 inches long providing sufficient mass when also secured to the ground (surface) to absorb the force of the returning divot piece 1. Also reflected in FIG. 1 are the elastic rubber bands 6 which are a total of 11 inches behind the hitting area when they become exposed at the end of the anchor piece 2. Looking down at the portable golf practice mat, the golfer sees mostly artificial grass 1 and 2, with only a few tees 10 and bands 6 extending from the anchor piece 2, far behind the hitting area reducing any apprehension which might otherwise be created, almost as natural looking as a real fairway.

Figure 2:
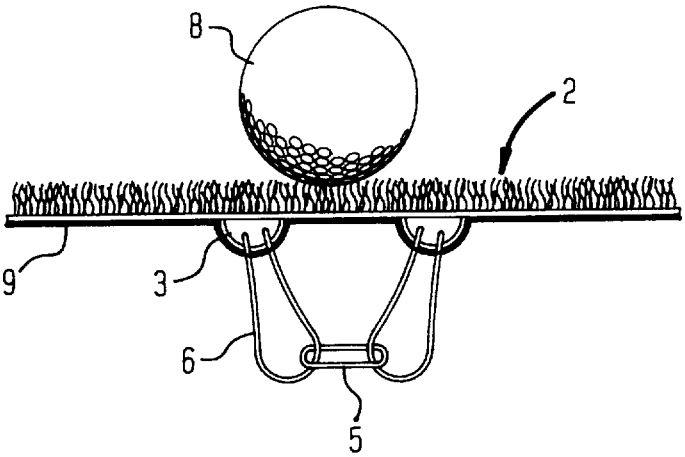
FIG. 2 is a sectional rear view of the device as seen through line 4—4 of FIG. 1.

FIG. 2 depicts the rear view of the preferred embodiment illustrating the U shape of the plastic tracks 3 which provide an avenue for the elastic rubber bands 6 to pass uninterrupted while protecting them from damage.

Figure 3:
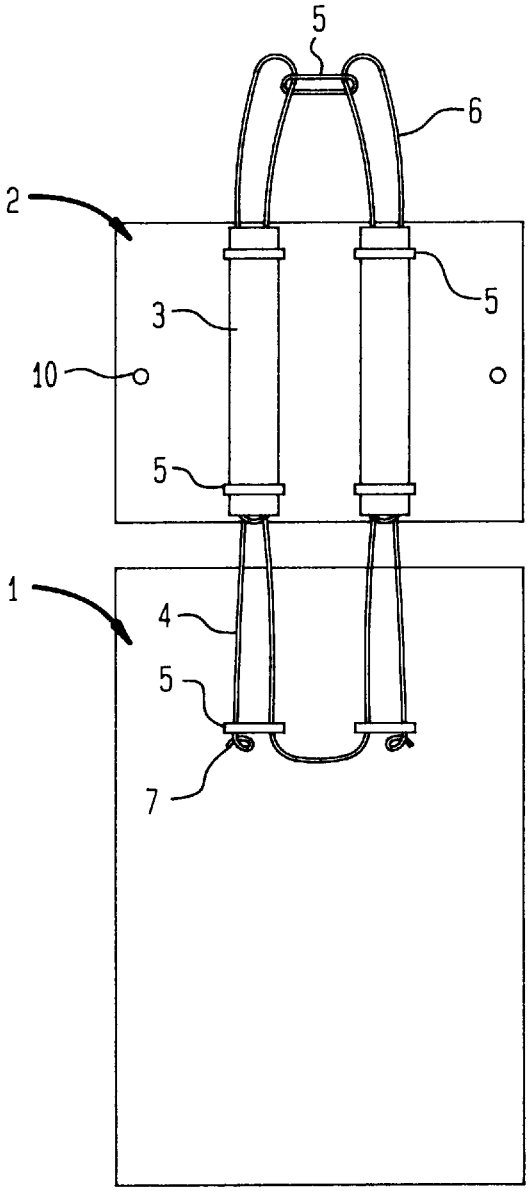
FIG. 3 is a bottom side view of the device on the line 2—2 of FIG. 1.

FIG. 3 illustrates the bottom side of the present invention with the lower surface of cloth tape 9 removed to reveal it's configuration. FIG. 3 reflects the divot piece 1 with a piece of ⅛th inch thick nylon cord 4, 8 inches in length with a knot 7 tied at each end. The nylon cord 4 is passed through the plastic cable tie fasteners 5 on the bottom side up to the knot 7 at each end. The nylon cord 4 is extended out from the divot piece 1 and passed through the elastic rubber bands 6 which are ⅜ths inches wide by 1/16th inch thick by 8 inches long in the preferred embodiment. This creates two secure and durable 1 and ¼ inch loops of nylon cord where ¼ inch of each loop extends from the divot piece 1 holding the bands 6 to the divot piece 1 and provides strength and concealment of the bands 6 in case of a mishit. Two pieces of smooth plastic 3/32nd inch thick by 1 inch wide by 4 inches long are folded into a U shape and secured to the bottom side of the anchor piece 2 using plastic cable tie fasteners 5. Each of the two individual bands 6 fastened to the divot piece 1 pass through the U shaped tracks 3 and are fastened to each other with a cable tie 5 at the opposite end so they can not pass back through the tracks completely. Divot piece 1 is now attached to anchor piece 2 via the elastic rubber bands 6. The bands move freely through the tracks 3 on piece 2 allowing the divot piece 1 to move forward and when the bands 6 and anchor piece 2 are independently secured to the ground, the divot piece 1 is pulled automatically back to it's original position next to the anchor piece 2 for the next shot. Cloth tape 9 is attached to the bottom of both pieces 1 and 2 individually to protect the various pieces and to provide a smooth surface for the divot piece to move.

Figure 4:
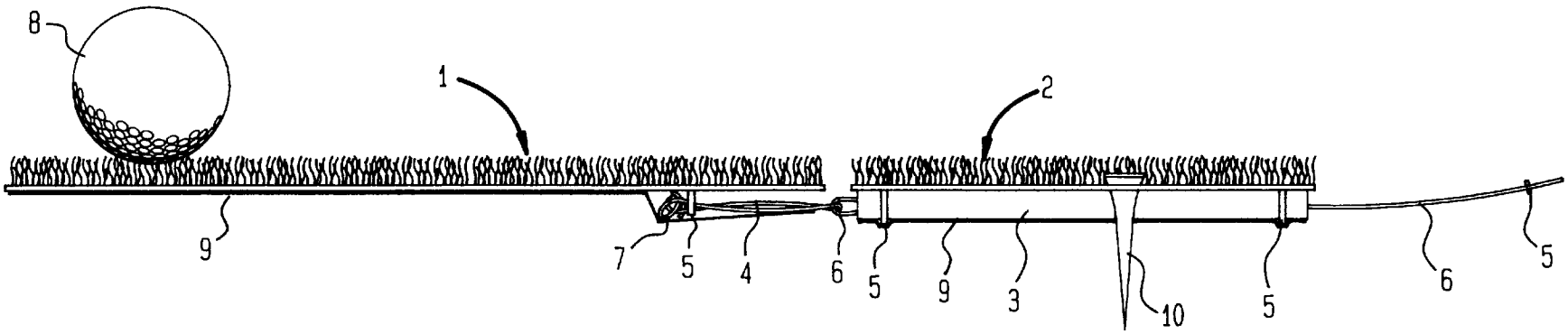
FIG. 4 is a sectional side view of the device as seen through line 3—3 of FIG. 1.

As shown in the cross sectional view of FIG. 4, the artificial turf means comprises plastic fibers ¾ inch high allowing movement of the golf club under the ball 8. A cloth and plastic mesh base 9 of minimum thickness supports these fibers and there is no need for additional padding which might impede some of the portability of the device as the ground provides the cushion and the movement of the divot piece offers the desired "give", almost duplicating a natural grass fairway, continuously. The construction of the device can be out of any conventionally available material using any of the fabrication and assembly methods generally known in the art that could produce similar results. As illustrated in FIG. 4, the divot piece 1 provides the area from which to hit golf balls 8 and is attached to the ground (or surface) via elastic rubber bands 6. There are no obstructions in the hitting area on either side nor in front. Those familiar with the art would realize the importance of this configuration in that there is no need for concern when employing a full swing and no need to adapt ones swing plane to avoid injury. The anchor piece 2 is constructed of the same material as the divot piece 1 and of the same width so as to provide a consistent appearance. It supports the U shaped tracks 3 which protect the bands and guides the movement of the divot. The anchor piece 2 works independent of the divot piece 1 when secured to the ground. The lightweight and simple construction of the device is key to it's portability.

Having thus described the invention in a preferred embodiment, it is to be understood that the invention is not limited to the embodiment set forth herein and that various modifications and revisions can be made to the embodiment as shown without deviating from the intent and scope of the invention. It is my intention, however, that all such modifications and revisions as are obvious to those skilled in the art will be included within the scope of the following claims.

I claim:

1. A portable artificial grass golf practice mat small in dimensions of 12 inches long by 3.5 inches wide, lightweight, and flexible enough to be carried in any golf bag that simulates the "give" of a natural fairway turf and provides for the proper swing plane arc of a golf shot when a golf ball is resting on the top by providing a level lie with the surrounding surface by replacing a natural divot created upon executing a golf swing with an artificial grass divot with said artificial divot of two piece construction of any commercially manufactured artificial grass material comprising a front divot piece for hitting balls that moves forward freely and returns automatically to it's original position via use of elastic rubber bands attached to the back end and a back anchor piece which secures the apparatus via golf tees to the ground and provides a base for the divot piece to return absorbing the return force of the divot piece and controlling it's return direction through the use of parallel plastic tracks through which the elastic rubber bands which secure the divot piece to the ground pass uninterrupted for maximum elasticity and absorption of force, thereby, allowing for the smallest size mat as all materials used and in the hitting area are golfer friendly and do not cause damage or injury upon contact.

2. A golf practice mat of claim 1 wherein said artificial turf mat comprising two piece construction of a divot and an anchor piece independent of each other but working in conjunction with each other performing separate functions:

a) a divot piece comprising an artificial grass surface of the smallest dimensions to hit golf balls, that being 3.5 inches wide or the width of a golf club, either an iron or fairway wood, and long enough to provide distance from the anchor piece in the event of a mishit of 8 inches providing a good comfort zone without generating too much force by minimizing the size to remain secured by golf tees and b) said divot piece having elastic rubber bands attached to it using nylon cord for extra strength in case of mishit which said bands fasten to the ground using golf tees and said bands are of such elasticity to provide significant movement of divot piece forward to absorb force generated by the downward blow of a club and to provide the "give" associated with a natural turf shot and c) an anchor piece comprising an artificial grass mat 4 inches long by 3.5 inches wide which fastens to the ground via golf tees providing stability for continuous shots by providing enough mass to offset and absorb the return force expelled by the returning divot piece to its original position next to the anchor piece, and housing parallel plastic tracks on the bottom side through which the elastic rubber bands attached to the divot piece pass, controlling the direction of movement of the divot piece, thus eliminating the need for an additional series of bands that by necessity in a small mat would be in the hitting area and d) said divot and anchor pieces comprising independent pieces adjoining via elastic rubber bands attached to the divot piece and passing freely through the plastic tracks attached to the anchor piece, then fastening together at the back end of the anchor piece, preventing them from passing back through the plastic tracks, thus adjoining the two pieces to form one device and eliminating the need for a rigid frame or heavy base to attach hitting area to for stability which would in turn eliminate the portability of any such apparatus, divot piece is anchored to the ground and anchor piece is anchored to the ground causing the ground to become the base.

3. A golf practice mat of claim 1 wherein said artificial turf mat comprising two piece construction of a divot and an anchor piece independent of but working in conjunction with each other wherein said divot has attached to it's bottom side 1 inch or more from the front end, 12 inch elastic rubber band(s) extending lengthwise along the divot piece and the anchor piece housed in parallel plastic tracks also attached to the bottom side of the divot piece and said band(s) fasten to the ground using golf tees and are of such elasticity to provide significant movement of divot piece forward to absorb the force generated by the downward blow of a club and to provide the "give" associated with a natural turf shot and the anchor piece providing stability for continuous shots by fastening to the ground (surface) using golf tees and securing the elastic rubber band(s) attached to the divot piece, thus, controlling the direction of movement and also providing enough mass to offset and absorb the return force expelled by the returning divot piece to its original position next to the anchor piece.

4. A two piece golf practice mat of claim 1 comprising of materials that are available for use such as artificial grass turf with thin rubber cushion base for the divot and anchor pieces and bongie cord for the band(s) wherein said divot piece, anchor piece, and band(s) provide the same functions of the device.

* * * * *